US005098608A

United States Patent [19]

Miyazawa et al.

[11] Patent Number: 5,098,608

[45] Date of Patent: Mar. 24, 1992

[54] TRANSPARENT SOLID DETERGENT COMPOSITIONS CONTAINING N-ACYL ACIDIC AMINO ACID SALTS

[75] Inventors: Kiyoshi Miyazawa; Kenichi Tomita, both of Yokohama; Yoshinobu Saito, Ibaraki; Nobuyuki Kishi, Ibaraki; Hirokatsu Kurimoto, Ibaraki; Hajimu Itoh, Ibaraki; Tetsuo Nishina, Ibaraki, all of Japan

[73] Assignees: Shiseido Company Ltd., Tokyo; Shieido Honey-Cake Industry, Ltd., Osaka, both of Japan

[21] Appl. No.: 588,043

[22] Filed: Sep. 25, 1990

[30] Foreign Application Priority Data

Sep. 29, 1989 [JP] Japan ..... 1-255034
Nov. 21, 1989 [JP] Japan ..... 1-304280

[51] Int. Cl.[5] ..... C11D 3/33; C11D 7/32; C11D 9/30; C11D 17/00

[52] U.S. Cl. ..... 252/546; 252/541; 252/544; 252/174; 252/DIG. 5; 252/DIG. 16

[58] Field of Search ..... 252/541, 544, 546, DIG. 16, 252/174, DIG. 5

[56] References Cited

U.S. PATENT DOCUMENTS 3,663,459 5/1972 Yoshida et al. ..... 252/546
4,273,684 6/1981 Nagashima et al. ..... 252/544

FOREIGN PATENT DOCUMENTS 5025465 2/1980 Japan .
56-76499 6/1981 Japan .
56-076500 6/1981 Japan .
62-027499 2/1987 Japan .
63-069898 3/1988 Japan .

*Primary Examiner*—Paul Lieberman
*Assistant Examiner*—Erin M. Higgins
*Attorney, Agent, or Firm*—Wegner, Cantor, Mueller & Player

[57] ABSTRACT

A transparent solid detergent composition containing salts of N-long chain acyl acidic amino acid wherein the salts of said N-long chain acyl acidic amino acid salt are composed of an alkali metal salt and an ethanolamine salt and the molar constituent ratio of the alkali metal and ethanolamine is 20:80 to 35:65.

5 Claims, No Drawings

TRANSPARENT SOLID DETERGENT COMPOSITIONS CONTAINING N-ACYL ACIDIC AMINO ACID SALTS

BACKGROUND OF THE INVENTION

1. Field of the Invention

The present invention relates to a transparent solid detergent composition. More specifically, it relates to an improved transparent solid detergent composition containing an N-long chain acyl acidic amino acid salt.

2. Description of the Related Art

A transparent solid detergent composition gives a feeling of high quality and has a high commercial value, and thus is used for soaps for washing the face and the like.

Usually conventional transparent solid detergent compositions are prepared by using fatty acid soaps as the base, and saccharoids such as glycerol, sorbitol, propylene glycol, or polyols as clarifiers, by the frame kneading method or mechanical kneading method.

The structural clarification mechanism of the transparent solid detergent composition thus prepared is considered to be such that the group of fibrous fine crystals of an opaque solid detergent composition with optically discontinuous sizes to visible light are vertically cleaved primarily relative to the fiber axes, which are made finer to the wavelength of visible light or less, to thereby clarify the solid detergent (Yu Kagaku 18, 804 (1969)).

Nevertheless, the transparent solid detergent composition obtained according to this clarification mechanism does not provide a good transparent appearance, and in the course of usage, a tendency toward a degrading of the commercial product value has been recognized, such that the soap surface is gelled and becomes opaque.

Accordingly, also in the prior art, a transparent solid detergent composition composed mainly of N-long chain acyl acidic amino acid salt has been developed (Japanese Unexamined Patent Publication (Kokai) No. 55-25465), and this transparent solid detergent composition has an excellent transparency, and further, does not have the drawback of becoming opaque during use.

Nevertheless, the above-mentioned transparent solid detergent composition comprising N-long chain acyl acidic amino acid salt has a problem of an inferior useability and a poor high temperature storability.

More specifically, the above-mentioned transparent solid detergent composition has a poor foaming property and does not give a good feeling during use, and is discolored to turn brown during storage under an environment of, for example, 30° C. or higher, resulting in a marked lowering of the commercial product value. Particularly, while displayed on store shelves, it is sometimes left to stand under relatively higher temperatures for a long time, and the commercial product value is greatly affected by whether or not the high temperature storability thereof is good.

SUMMARY OF THE INVENTION

Accordingly, the objects of the present invention are to eliminate the above-mentioned disadvantages of the prior art and to provide a transparent solid detergent composition having a good transparency, a good useability, and a good storability.

Other objects and advantages of the present invention will be apparent from the following description.

In accordance with the present invention, there is provided a transparent solid detergent composition comprising the salts of an N-long chain acyl acidic amino acid, wherein the salts of said N-long chain acyl acidic amino acid salt are composed of an alkali metal salt and an ethanolamine salt and wherein the molar constituent ratio of the alkali metal and ethanolamine is 20:80 to 35:65.

DESCRIPTION OF THE PREFERRED EMBODIMENTS

According to the present invention, the above-mentioned objects can be accomplished by constituting the salts of N-long chain acyl acidic amino acid salts as an alkali metal salt and ethanolamine salt, and by making the constitutional ratio thereof a specific ratio, whereby the transparency, useability, and storability thereof can be improved.

The constitution of the present invention is now described.

N-Long Chain Acyl Acidic Amino Acid salts

Examples of the N-long chain acid acidic amino acid salts usable in the present invention are N-long chain acylglutamic acid salts, and N-long chain acylaspartic acid salts.

Further, the alkalis of the N-long chain acyl acidic amino acid salts must be a mixture of an alkali metal salt such as sodium salt or potassium salt and an ethanolamine salt such as monoethanolamine salt, diethanolamine salt, and triethanolamine salt, and the molar constituent ratio of the alkali metal to ethanolamine must be 20:80 to 35:65, preferably 25:75 to 30:70.

When the molar constituent ratio of ethanolamine is more than 80, the high temperature storability will be worsened to readily cause a brown discoloration thereof, and when less than 65, the transparency will be worsened.

The amount of N-long chain acyl acidic amino acid salts formulated depends on the molar constituent ratio of counter ions (alkali metal/ethanolamine), but to attain the transparent state of the present invention, the formulated amount thereof is preferably 35% by weight to 80% by weight, more preferably 40% by weight to 70% by weight.

When a basic amino acid is used in place of ethanolamine, a brown discoloration is liable to occur during high temperature storage.

The transparent solid detergent composition obtained in the present invention has a superior transparency, compared with transparent soaps of the prior art, and the present inventors have made further investigations into this phenomenon.

As a result, it has been found that the transparent solid detergent composition according to the present invention is essentially different from the transparent soap of the prior art, and has a crystalline structure in the liquid crystal state.

It has been also confirmed that, even if the same starting materials are employed, unless a liquid crystal state is obtained, the transparency becomes comparable with the transparent soap of the prior art.

Further, in a transparent soap which is not in a liquid crystal state, problems arise in that the soap surface is gelled to become opaque, and this is due to a residual water-insoluble portion. Therefore, in the transparent solid detergent composition wherein the detergent composition as a whole is a uniform liquid crystal system as in the present invention, a water-insoluble portion will not remain and the soap surface will not be gelled to become opaque during use.

Namely, because the crystalline structure of the transparent solid detergent composition according to the present invention is a liquid crystal, it has a superior transparency, useability, and stability.

N-long chain acyl acidic amino acid salts can be easily obtained by neutralizing a N-long chain acyl acidic amino acid with alkalis, and the neutralization degree at that time affects the formation of a liquid crystal.

Therefore, to obtain a good liquid crystal state, the neutralization degree of alkalis relative to N-long chain acyl acidic amino acids must be sesqui (i.e., 1.5 equivalents) neutralization or more and 1.8 equivalents or less.

In N-long chain acyl acidic amino acid salts with a neutralization degree of less than 1.5 equivalents, the transparency is poor, and thus a liquid crystal as a transparent solid cannot be obtained.

Alternatively, N-long chain acyl acidic amino acid mono-salts and N-long chain acyl acidic amino acid di-salts may be mixed to make the neutralization degree of the mixture 1.5 equivalents or more.

When the neutralization degree is more than 1.8, a brown discoloration will readily occur, and thus the high temperature storability will be worsened.

The pH of the detergent composition according to the present invention is preferably from 6.3 to 7.5, as measured in a 1% aqueous solution at 25° C., more preferably 6.8±0.3.

When the pH becomes 6.3 or less, the transparency is badly affected, and when the pH becomes 7.5 or higher, a brown discoloration will readily occur.

Further, according to the present invention, by an addition of a cationic polymer and an amphoteric surfactant as described below, a desired improvement of the dissolution disintegration resistance, frictional solubility, and foamability can be obtained.

Cationic Polymer

Examples of the cationic polymer usable in the present invention, are polydimethyldiallylammonium chloride, hydroxyethylcellulose trimethylammonium chloride, hydroxyethylcellulose alkyltrimethylammonium chloride, hydroxypropyl guar gum alkyltrimethylammonium chloride, galactomannan alkyltrimethylammonium chloride, and acrylic acid β-N,N-dimethyl-N-ethylantinioethyl salt vinyl pyrrolidone copolymer. These polymers can be used alone or in any mixture thereof.

Amphoteric Surfactant

Examples of the amphoteric surfactant usable in the present invention are the amide betaine type amphoteric surfactants represented by the following formula (I), the betaine type amphoteric surfactants represented by the following formula (II), the imidazolinium betaine type amphoteric surfactants represented by the following formula (III), the sulfobetaine type amphoteric surfactants represented by the following formula (IV). These compounds can be used alone or in any mixture thereof.

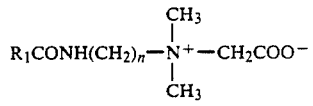

(I)

(wherein, $R_1$ represents an alkyl group or an alkenyl group having 7 to 21 carbon atoms on an average, and n represents an integer of 1 to 4)

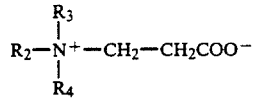

(II)

(wherein, $R_2$ represents an alkyl group or an alkenyl group having 7 to 21 carbon atoms on an averae, $R_3$ and $R_4$ represent alkyl groups having 1 to 2 carbon atoms)

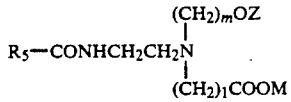

(III)

(wherein, $R_5$ represents an alkyl group or alkenyl group having 7 to 21 carbon atoms on an average, m and l are integers of 1 to 3, z is hydrogen atom or a $-(CH_2)_pCOOY$ group (p is an integer of 1 to 3, Y an alkali metal, an alkaline earth metal or an organic amine), M represents an alkali metal, an alkaline earth metal or an organic amine)

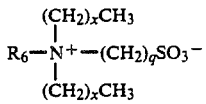

(IV)

(wherein, $R_6$ represents an alkyl group or alkenyl group having 8 to 22 carbon atoms on an average, x is an integer of 0 to 3, and q is an integer of 2 to 4).

The amount of the cationic polymer and the amphoteric surfactant formulated is preferably 0.01 to 10% by weight, more preferably 0.1 to 5% by weight. When the amount of the cationic polymer and the amphoteric surfactant formulated is less than 0.01% by weight, a desired improvement of the dissolution disintegration resistance, frictional solubility, foamability cannot be obtained, and when formulated in an amount of more than 10% by weight, the transparency and solidity will be undesirably worsened.

The formulation ratio of the cationic polymer to the amphoteric surfactant is preferably 95:5 to 5:95, more preferably 70:30 to 20:80. The acting mechanism of both in the present invention has not been clarified, but a product satisfying all of the dissolution disintegration resistance, frictional solubility, foamability, and low temperature stability cannot be obtained by each formulation alone, thus clearly suggesting the synergestic effect of both.

As described above, by a formulation of a cationic polymer and an amphoteric surfactant into the transparent solid detergent according to the present invention, a transparent solid detergent having an excellent transparency, dissolution disintegration resistance, frictional solubility, and low temperature stability can be provided.

In the present invention, in addition to N-long chain acyl acidic amino acid salts, polyhydric alcohols, lower alcohols and other components can be formulated.

Polyhydric Alcohol

The polyhydric alcohol in the present invention is preferably formulated in an amount of 5% by weight to 30% by weight, more preferably 8% by weight to 25% by weight.

Examples of the polyhydric alcohol are glycerine, propylene glycol, sorbitol, ethylene glycol, and diglycerine.

When the amount formulated is 5% by weight or less, the N-long chain acyl acidic amino acid salts will be crystallized, and when 30% by weight or more, the resultant composition will form a solution.

Lower Alcohol

Preferably, the lower alcohol in the present invention can be formulated at a formulation weight ratio of polyhydric alcohol to lower alcohol of 10:1 to 1:5, more preferably 5:1 to 1:2.

When the formulation weight ratio of polyhydric alcohol to lower alcohol (polyhydric alcohol/lower alcohol) is 10/1 or higher, production will become impossible due to thickening during heating dissolution, and when 1/5 or less, the drying period is prolonged or the transparency may be worsened.

Examples of the lower alcohol are ethyl alcohol, propyl alcohol and the like.

Other Components

In the transparent solid detergent composition of the present invention, in addition to the components described above, known formulation components conventionally formulated can be formulated in the detergent composition.

For example, there can be formulated anionic surfactants, cationic surfactants, amphoteric surfactants, nonionic surfactants, sterilizers (e.g., methyl paraben, trichlorocarbanilide, benzekonium chloride, sulfur), humectants, oil components (e.g., squalane, hydrocarbon, silicone oil), perfumes, dyes (e.g., acid fuchsine D, alizarin cyanine green F, tartrazine), chelating agents (e.g., ethylenediaminetetraacetic acid sodium salts, 1-hydroxyethane-1,1-diphosphonic acid tetrasodium salt, trisodium edetate, 1-hydroxyethane 1,1-diphosphonic acid tetrasodium salt), UV-ray absorbers (e.g., 2-hydroxy-4-methoxybenzophenone, oxybenzone, urocanic acid), antioxidants (e.g., dibutylhydroxy toluene, butylhydroxy toluene, tocopherol), galenicals, nonionic, cationic or anionic water-soluble polymers (e.g., polyethylene oxide), in an amount which does not impair the transparency of the present composition.

Further to improve the foamability, within the range which does not impair the effects of the transparent solid detergent composition, for example, it is possible to formulate anionic surfactants such as polyoxyethylene alkylsulfates, N-acylsarcosinates, N-acyl-N-methyltaurates, phosphate esters, sulfosuccinates, α-olefinsulfonates, higher fatty acid ester sulfonates, fatty acid soaps; nonionic surfactants such as alkanolamide, polyoxyethylene alkyl ether, polyethylene oxide polypropylene oxide block copolymer. Further, as the additive, there may be included humectants such as pyrrolidone carboxylic acid, sodium pyrrolidone carboxylate, hyaluronic acid, polyoxyethylene alkylglucoside ether, and natural extracts such as lecithin, saponin, aloe, oobaku, and camomile. Especially, a lactic acid ester having a specific feature in useability (moistness) was not formulated in conventional general soaps, because alkalinity is a cause of decomposition, but in the present invention, it can be formulated with a good stability.

The detergent composition of the present invention may be prepared by the frame kneading method. More specifically, a mixture of N-long chain acyl acidic amino acid salts having an acyl group of 10 to 22 carbon. atoms with a neutralization degree of 1.5 to 1.8 equivalents and a lower alcohol, optionally together with other surfactants and other additives, added with water is heated to 70° to 80° C. to be dissolved uniformly, then poured into a mold to be cooled and solidified, and then a drying aging is effected to give the detergent composition of the present invention.

The drying period depends on the amounts of the polyhydric alcohol and lower alcohol formulated, but is usually about 2 to 40 days.

EXAMPLES

The present invention will now be further illustrated in detail by, but is by no means limited to, the following Examples, wherein "percents" are all by weight unless otherwise noted.

First, prior to the Examples, the test methods employed when evaluating the respective formulated samples are described.

Confirmation of Liquid Crystal

The transparent solid detergent composition according to the present invention has a superior transparency due to the liquid crystal state thereof, and a confirmation of the liquid crystal state was performed for each sample by X-ray diffraction, differential thermal analysis and polarization microscope observation, and a sample giving the results as shown below was determined to be in the liquid crystal state.

From the X-ray diffraction, it is possible to determine whether the long chain acyl group is liquid or crystalline, from the presence or absence of the peak appearing at around $\theta=20°$, and the long chain acyl group must be liquid, i.e., no peak should appear at around $\theta=20°$ during the X-ray diffraction.

On the other hand, a differential thermal analysis (a range of from 20° C. to 110° C.), allows the phase transition temperature of each sample from crystal to liquid crystal, or from liquid crystal to solution, to be observed, but a phase transition temperature must not be observed from the result of a differential thermal analysis in the solid detergent of the present invention.

With a polarization microscope, it is possible to determine whether each sample is isotropic or anisotropic, and the detergent of the present invention must be isotropic when under polarization microscope observation.

Transparency

Each sample is cut uniformly to a thickness of 20 mm, placed on 26 point print type, and the readability thereof is determined and evaluated according to the following evaluation standards.

◎... Clearly readable
○... Readable
Δ... Difficult to read
x ... Unreadable

Solidness

The firmness of each sample is evaluated by contact, as a solid detergent, according to the following evaluation standards.

○... Firm
Δ... Not firm
x ... Soft

Foaming

Each sample is foamed by hand by a panel of 20 women, 20 to 30 years old, as in actual use during usual hand washing, and the foaming is evaluated by an average score.

◎... Very good foaming
○... Good foaming
Δ... Usual foaming
x ... Poor foaming

High Temperature Storability

Each sample is stored in a thermostat tank at 30° C., and the degree of brown discoloration after 2 months is observed.

◎... No brown discoloration
○... Slight discoloration observed compared with color immediately after preparation, but no influence on commercial product value
Δ... Brown discoloration observed
x ... Marked brown discoloration, commercial product value very low.

Low Temperature Stability

Each sample is left to stand in a thermostat tank of 0° C., and the stability is determined after 2 weeks.

○... Very good transparency without change
Δ... Slightly lowered transparency
x ... Opaque or crystal line appearance

Producibility

The respective formulated components are heated to 70° to 80° C. to be uniformly melted, then cast into a frame, cooled, and solidified. The resultant product is cut, dried, and molded to obtain a solid detergent, and the producibility during these production steps is evaluated as below.

○... Good producibility
Δ... Slightly thickened during heating but producible
x ... Greatly thickened during heating, and uniformalization impossible or not solidified during removal from frame.

Dissolution Disintegration

A previously weighed sample is attached to a wire and dipped into water at 20° C., taken out after one hour, and then weighed. The dissolution ratio is calculated from the following calculation formula, and is used as an evaluation of the dissolution disintegration.

$$\text{Dissolution ratio (\%)} = \frac{W_1 - W_2}{W_1} \times 100$$

$W_1$: sample weight before dipping (g)
$W_2$: sample weight before dipping (g).
$W_2$: sample weight after dipping (g).

Frictional Solubility

This is measured according to JIS K-3304.

More specifically, a soap chip having a constant weight (cross-section 15 mm×20 mm) is placed on a film surface wetted with tap water adjusted to 40° C., and the film is rotated to effect frictional dissolution for 10 minutes.

From the weights before and after frictional dissolution, the solubility is determined as the frictional solubility per constant area from the following formula:

$$\text{Frictional solubility (\%)} = (\text{Former weight} - \text{Latter weight}) \times 100/3.$$

Foamability

Using an artificial hard water of $CaCO_3$ 100 ppm, 400 ml of an aqueous 1% solution of a sample is prepared, stirred in a cylinder equipped with a stirrer at a temperature of 25° C. for one minute, and the foaming amount immediately after stirring is measured and evaluated as shown below.

◎... Foaming amount: 1900 ml or more
○... Foaming amount: 1700 to less than 1900 ml
ΔFoaming amount: 1500 to less than 1700 ml
x ... Foaming amount: less than 1500 ml.

Relationship Between Molar Constituent Ratio of Counter Ions and Various Characteristics A transparent solid detergent composition having the following composition was prepared, and the various characteristics thereof were examined.

| | |
|---|---|
| N-long chain acyl glutamic acid salts | 50% |
| Glycerol | 15% |
| Ethyl alcohol | 10% |
| Deionized water | balance |

The N-long chain acyl glutamic acid salts were constituted of sodium salt and triethanolamine salt (1.6 equivalent neutralized product), and the molar constituent ratio of sodium/triethanolamine (counter ion ratio) was successively varied.

The results are shown below in Table 1.

TABLE 1

| | | Test Example | | | | | | | |
|---|---|---|---|---|---|---|---|---|---|
| | | 1 | 2 | 3 | 4 | 5 | 6 | 7 | 8 |
| Counter ion ratio | | 45/55 | 40/60 | 35/65 | 30/70 | 25/75 | 20/80 | 15/85 | 10/90 |
| Liquid crystal state | X-ray diffraction (peak) | " | " | None | None | None | None | None | None |
| | Differential thermal analysis (peak) | " | None | None | None | None | None | None | None |
| | Polarization microscope *1 | Aniso | Iso | Iso | Iso | Iso | Iso | Iso | Iso |
| Transparency | | X | Δ | ○ | ◎ | ◎ | ◎ | ◎ | ◎ |
| Solidness | | ○ | ○ | ○ | ○ | ○ | ○ | ○ | ○ |
| Foaming | | ◎ | ◎ | ◎ | ◎ | ◎ | ◎ | Δ | X |

TABLE 1-continued

| | Test Example | | | | | | | |
|---|---|---|---|---|---|---|---|---|
| | 1 | 2 | 3 | 4 | 5 | 6 | 7 | 8 |
| High temperature storability | ○ | ○ | ◎ | ◎ | ◎ | ◎ | Δ | X |

*1 Iso: isotropic Aniso: anisotropic

As apparent from Table 1, the transparency becomes better as the molar constituent ratio of triethanolamine becomes higher, and a satisfactory transparency is obtained when the molar constant ratio is 65% or more.

On the other hand, if the molar constituent ratio of triethanolamine becomes higher and exceeds 80%, a brown discoloration will occur under high temperature storage, and thus the high storage storability is worsened.

Accordingly, the molar constituent ratio of an alkali metal to ethanolamine is preferably 35/65 to 20/80.

Formulation Ratio of Cationic Polymer to Amphoteric Surfactant and Various Characteristics A transparent solid detergent composition having the following composition was prepared, and the various characteristics thereof were examined.

| | |
|---|---|
| N-long chain acyl glutamic acid salts | 50% |
| Mixture of polydimethyldiallylammonium chloride and coconut oil fatty acid amide propylacetic acid betaine | 3% |
| Glycerol | 15% |
| Ethyl alcohol | 10% |
| Deionized water | balance |

The N-long chain acyl glutamic acid salts were constituted of sodium salt and triethanolamine salt with a counter ion ratio of 25/75 and 1.6 equivalent neutralized product).

The results are shown below in Table 2.

TABLE 2

| | | Test Example | | | | | | | |
|---|---|---|---|---|---|---|---|---|---|
| | | 9 | 10 | 11 | 12 | 13 | 14 | 15 | 16 |
| Mixing ratio | | 100/0 | 95/5 | 80/20 | 70/30 | 50/50 | 20/80 | 5/95 | 0/100 |
| Liquid crystal state | X-ray diffraction (peak) | None | None | None | None | None | None | None | None |
| | Differential thermal analysis (peak) | None | None | None | None | None | None | None | None |
| | Polarization microscope *1 | Iso | Iso | Iso | Iso | Iso | Iso | Iso | Iso |
| Transparency | | ◎ | ◎ | ◎ | ◎ | ◎ | ◎ | ◎ | ◎ |
| Solidness | | ○ | ○ | ○ | ○ | ○ | ○ | ○ | ○ |
| Foaming | | ○ | ◎ | ◎ | ◎ | ◎ | ◎ | ◎ | Δ |
| Dissolution ratio | | 42.6 | 31.2 | 15.6 | 10.7 | 8.3 | 11.2 | 25.8 | 47.9 |
| Frictional solubility | | 51.2 | 34.7 | 22.5 | 19.8 | 20.3 | 19.4 | 32.2 | 45.8 |
| Low temperature storability | | X | ○ | ○ | ○ | ○ | ○ | ○ | Δ |

*1 Iso: isotropic Aniso: anisotropic

As apparent from Table 2, an addition of polydimethyldiallylammonium chloride (cationic polymer) or coconut oil fatty acid amide propylacetic acid betaine (amphoteric surfactant) alone, substantially does not improve the dissolution ratio, frictional solubility, foaming, and low temperature stability.

In contrast, by formulating both at a ratio of 95:5 to 5:95, improvements can be seen in the above-mentioned various characteristics, and particularly excellent improvements are seen at a ratio of 70:30 to 20:80.

Thus, it can be understood that, through the synergestic effect of a cationic polymer and an amphoteric surfactant, a very good improvement of the dissolution ratio, frictional solubility, low temperature stability, and foaming can be obtained.

Formulation Amounts of Cationic Polymer and Amphoteric Surfactant, and Various Characteristics A transparent solid detergent composition having the following composition was prepared, and the various characteristics thereof were examined.

| | |
|---|---|
| N-long chain glutamic acid salts | 50% |
| Mixture of polydimethyldiallyammonium chloride and coconut oil fatty acid amide propylacetic acid betaine (5:5) | X% |
| Glycerol | 15% |
| Ethyl alcohol | 10% |
| Deionized water | balance |

The N-long chain acyl glutamic acid salts were constituted of sodium salt and triethanolamine salt with a counter ion ratio of 25/75 and 1.6 equivalent neutralized product.

The results are shown in Table 3.

TABLE 3

| | | Test Example | | | | | | | |
|---|---|---|---|---|---|---|---|---|---|
| | | 17 | 18 | 19 | 20 | 21 | 22 | 23 | 24 |
| Amount of mixture formulated | | 0 | 0.001 | 0.01 | 0.1 | 1.0 | 5.0 | 10.0 | 15.0 |
| Liquid crystal state | X-ray diffraction (peak) | None | None | None | None | None | None | None | None |
| | Differential thermal analysis (peak) | None | None | None | None | None | None | None | None |
| | Polarization microscope *1 | Iso | Iso | Iso | Iso | Iso | Iso | Iso | Iso |
| Transparency | | ◎ | ◎ | ◎ | ◎ | ◎ | ◎ | ◎ | Δ |
| Solidness | | ○ | ○ | ○ | ◎ | ◎ | ○ | ○ | X |

TABLE 3-continued

| | Test Example | | | | | | | |
|---|---|---|---|---|---|---|---|---|
| | 17 | 18 | 19 | 20 | 21 | 22 | 23 | 24 |
| Foaming | ○ | ○ | ○ | ○ | ○ | ○ | ○ | Δ |
| Dissolution ratio | 48.2 | 50.1 | 32.2 | 13.6 | 7.2 | 6.3 | 8.1 | 10.2 |
| Frictional solubility | 61.2 | 49.3 | 34.8 | 24.5 | 18.7 | 19.2 | 20.9 | 22.4 |
| Low temperature stability | Δ | Δ | ○ | ○ | ○ | ○ | ○ | ○ |

*1 Iso: isotropic Aniso: anisotropic

As apparent from Table 3, when the amount of the mixture of a cationic polymer and an amphoteric surfactant is 0.01 to 10% by weight, the desired improvement can be recognized, and particularly excellent effects are exhibited at 0.1 to 5% by weight.

On the other hand, when more than 10% by weight, the solidity and transparency will be undesirably worsened.

In the following, the transparent solid detergent compositions of Examples 1 to 6 and Comparative Examples 1 to 8, obtained without producibility problems, were dried for about one month and then tested for a confirmation of the liquid crystal state, transparency, solidity, foaming, and low temperature stability.

The results are shown in Tables 4(A) and 4(B).

TABLE 4(A)

| | | Example | | | | | |
|---|---|---|---|---|---|---|---|
| | | 1 | 2 | 3 | 4 | 5 | 6 |
| N-long chain acylglutamic acid salt (Neutralization degree 1.2) | | — | — | — | — | — | — |
| N-long chain acylglutamic acid salt (Neutralization degree 1.8) | | 40 | 70 | 50 | 50 | 50 | 50 |
| Counter ion ratio | | 30/70 | 30/70 | 25/75 | 35/65 | 25/75 | 25/75 |
| Glycerol | | 15 | 10 | 10 | 10 | 25 | 8 |
| Ethyl alcohol | | 10 | 15 | 12 | 12 | 5 | 30 |
| Deionized water | | 35 | 5 | 28 | 28 | 20 | 12 |
| Producibility | | ○ | ○ | ○ | ○ | ○ | ○ |
| Liquid crystal state | X-ray diffraction (peak) | None | None | None | None | None | None |
| | Differential thermal analysis (peak) | None | None | None | None | None | None |
| | Polarization microscope *1 | Iso | Iso | Iso | Iso | Iso | Iso |
| Transparency | | ◎ | ○ | ◎ | ○ | ◎ | ◎ |
| Solidness | | ○ | ○ | ○ | ○ | ○ | ○ |
| Foaming | | ○ | ◎ | ○ | ◎ | ○ | ○ |
| High temperature stability | | ◎ | ◎ | ◎ | ◎ | ◎ | ◎ |

*1 Iso: isotropic, Aniso: anisotropic

TABLE 4(B)

| | | Comparative Example | | | | | | | |
|---|---|---|---|---|---|---|---|---|---|
| | | 1 | 2 | 3 | 4 | 5 | 6 | 7 | 8 |
| N-long chain acylglutamic acid salt (Neutralization degree 1.2) | | 40 | 50 | — | — | — | — | — | — |
| N-long chain acylglutamic acid salt (Neutralization degree 1.8) | | — | — | 50 | 50 | 50 | 50 | 90 | 50 |
| Counter ion ratio | | 3070 | 25/75 | 10/90 | 80/20 | 25/75 | 25/75 | 25/75 | 25/75 |
| Glycerol | | 15 | 10 | 10 | 10 | 2 | 12 | 5 | 0 |
| Ethyl alcohol | | 10 | 12 | 12 | 12 | 10 | 1 | 5 | 0 |
| Deionized water | | 35 | 28 | 28 | 28 | 38 | 37 | 0 | 50 |
| Producibility | | ○ | ○ | ○ | ○ | Δ | X | X | X |
| Liquid crystal state | X-ray diffraction (peak) | " | " | None | " | None | — | — | — |
| | Differential thermal analysis (peak) | " | " | None | " | " | — | — | — |
| | Polarization microscope *1 | Aniso | Aniso | Iso | Aniso | Aniso | — | — | — |
| Transparency | | X | X | ◎ | Δ | ○ | — | — | — |
| Solidness | | ○ | ○ | Δ | Δ | Δ | — | — | — |
| Foaming | | ◎ | ○ | Δ | ◎ | ○ | — | — | — |
| High temperature stability | | ○ | ◎ | X | ○ | ◎ | — | — | — |

*1 Iso: isotropic Aniso: anisotropic

As apparent from Table 4(A) and (B), when the neutralization degree of the N-long chain acylglutamic acid salts is 1.5 or less (Comparative Examples 1 and 2), the transparency is poor and a transparent solid detergent composition cannot be formed. Of course, from the observation results by X-ray diffraction, differential thermal analysis, and polarization microscope, it is understood that a liquid crystal state is not obtained.

Therefore, the neutralization degree of the N-long chain acylglutamic acid salts must be 1.5 or more.

When the molar constituent ratio of triethanolamine of the N-long chain acylglutamic acid salts is 80% or more (Comparative Example 3), although the liquid state can be confirmed and the transparency is good, the solidity and foaming are not good, and in particular, the high temperature storability is worsened, thus posing problems in the functions thereof as a detergent composition.

On the other hand, when the molar constituent ratio of triethanolamine is 65% or less (Comparative Example 4), a liquid crystal state cannot be obtained, thus worsening the transparency.

Therefore, it is confirmed that a good transparent solid detergent can be obtained at a counter ion ratio of about 20:80 to 35:65.

When the glycerine (polyhydric alcohol) is less than 5% (Comparative Examples 5, 8), a liquid crystal state cannot be confirmed, and the transparency and solidity are poor. Accordingly, it is understood that about 5% or more of a polyhydric alcohol must be used.

When the ethyl alcohol (lower alcohol) is about 12:1 relative to polyhydric alcohol (Comparative Example 6), the producibility of a solid detergent becomes extremely poor.

On the other hand, an addition of ethyl alcohol at a ratio of 1:5 or more relative to the polyhydric alcohol will influence the drying aging, and therefore, the formulation ratio of a lower alcohol relative to a polyhydric alcohol must be 10:1 to 1:5.

When the amount of N-long chain acylglutamic acid salts exceeds 80% (comparative Example 7), the producibility is greatly worsened.

On the other hand, when the amount of N-long chain acylglutamic acid salts is 35% or less, substantially no detergent can e formed, and therefore, the N-long chain acylglutamic acid salts must be 35 to 80% by weight.

Examples formulated with a cationic polymer and an amphoteric surfactant are shown together with Comparative Examples.

Each sample was prepared by heating the respective formulated components to 70° to 80° C. to dissolve them uniformly, casting the solution in a frame followed by colling and solidification, and removing the product form the frame and cutting. The samples without problems in the preparation steps were dried for about one month and molded, and the above respective tests were conducted therefor to obtain the results shown in Tables 5(A) and (B).

TABLE 5(A)

| | Example | | | | | |
|---|---|---|---|---|---|---|
| | 7 | 8 | 9 | 10 | 11 | 12 |
| N-long chain mixed fatty acid acyl-L-glutamic acid salts (1.2 equivalent neutralization, counter ion ratio 25/75) | — | — | — | — | — | — |
| N-long chain mixed fatty acid acyl-L-glutamic acid salts (1.8 equivalent neutralization, counter ion ratio 25/75) | 50 | 75 | 50 | 50 | 50 | 50 |
| Polydimethyldiallylammonium chloride *1 | 6 | 3 | 0.3 | 10 | 8 | 2.5 |

TABLE 5(A)-continued

| | Example | | | | | |
|---|---|---|---|---|---|---|
| | 7 | 8 | 9 | 10 | 11 | 12 |
| Coconut oil fatty acid amide propylacetic acid betaine *2 | 8 | 2 | 0.5 | 15 | 5 | 14 |
| Glycerol | 10 | 8 | 10 | 8 | 8 | 8 |
| Sorbitol | 3 | 2 | 3 | — | 1 | 1 |
| Ethyl alcohol | 15 | 10 | 15 | 10 | 12 | 12 |
| Deionized water | 8 | 0 | 21.2 | 7 | 16 | 12.5 |
| Transparency | ◎ | ○ | ◎ | ○ | ◎ | ◎ |
| Solidness | ○ | ○ | ○ | ○ | ○ | ○ |
| Dissolution ratio (%) | 10.2 | 20.5 | 30.2 | 7.5 | 8.7 | 12.3 |
| Frictional solubility (%) | 18.3 | 27.8 | 35.3 | 21.8 | 19.7 | 26.3 |
| Low temperature stability | ○ | ○ | ○ | ○ | ○ | ○ |
| Foamability | ◎ | ◎ | ○ | ◎ | ◎ | ◎ |

*1 trade name "Merquat 100" manufactured by Merck (40% aqueous solution)
*2 trade name "Rebon 2000" manufactured by Sanyo Kasei (30% aqueous solution)

TABLE 5(B)

| | Comparative Example | | | | | |
|---|---|---|---|---|---|---|
| | 9 | 10 | 11 | 12 | 13 | 14 |
| N-long chain mixed fatty acid acyl-L-glutamic acid salts (1.2 equivalent neutralization, counter ion ratio 25/75) | — | — | — | — | — | — |
| N-long chain mixed fatty acid acyl-L-glutamic acid salts (1.8 equivalent neutralization, counter ion ratio 25/75) | — | 30 | 50 | 50 | 50 | 50 |
| Polydimethyldiallylammonium chloride *1 | 6 | 6 | 10 | — | 0.01 | 15 |
| Coconut oil fatty acid amide propylacetic acid oetaine *2 | 8 | 8 | — | 10 | 0.01 | 20 |
| Glycerol | 10 | 10 | 10 | 10 | 10 | 1 |
| Sorbitol | 3 | 3 | 3 | 3 | 3 | 3 |
| Ethyl alcohol | 15 | 15 | 15 | 15 | 15 | 5 |
| Deionized water | 8 | 28 | 12 | 12 | 31.98 | — |
| Transparency | X | Not solidified | ◎ | ◎ | ◎ | Preparation impossible |
| Solidness | ○ | Not solidified | ○ | ○ | ○ | Preparation impossible |
| Dissolution ratio (%) | 10.3 | Not solidified | 38.7 | 45.2 | 50.3 | Preparation impossible |
| Frictional solubility (%) | 25.8 | Not solidified | 50.3 | 53.2 | 65.3 | Preparation impossible |
| Low temperature stability | X | Not solidified | X | ○ | ○ | Preparation impossible |
| Foamability | ○ | Not solidified | Δ | Δ | ○ | Preparation impossible |

*1 trade name "Merquat 100" manufactured by Merck (40% aqueous solution)
*2 trade name "Rebon 2000" manufactured by Sanyo Kasei (30% aqueous solution)

As apparent from Tables 5(A) and (B), when the neutralization degree is 1.5 or less (Comparative Example 9), the transparency is poor as described above, and thus a transparent solid detergent cannot be formed.

When the amount of N-long chain mixed fatty acid acyl-L-glutamic acid triethanolamine salt formulated is less than 35% by weight (Comparative Example 10), the product is in the form of a solution and is not solidified.

Therefore, it is confirmed that the amount of N-coconut oil fatty acid acyl-L-glutamic acid triethanolamine salt formulated must be 35% by weight or more.

When an amphoteric surfactant (coconut oil fatty acid amide propylacetic acid betaine) is not formulated (Comparative Example 11), although the transparency and solidity may be good, the dissolution ratio (38.7%) and frictional solubility (50.3%) are too high, and the low temperature stability also becomes poor.

On the other hand, if a cationic polymer (polydimethyldiallylammonium chloride) is not formulated (Comparative Example 12), the dissolution ratio (45.2%) and frictional solubility (53.2%) are again too high, and the foamability becomes poor.

Accordingly, a cationic polymer and an amphoteric surfactant each alone have substantially no effect, and only in the case, through the synergestic action of both, it becomes possible to obtain a high dissolution disintegration resistance, good frictional solubility, and good low temperature stability.

Further, when the amount of the mixture of polydimethyldiallylammonium chloride and coconut oil fatty acid amide propylacetic acid betaine is less than 0.1% by weight (Comparative Example 13), as in the case of the above-mentioned single addition, although the transparency and solidity may be good, the dissolution ratio and frictional solubility are too high and good results cannot be obtained.

Therefore, the amount formulated of the cationic polymer and the amphoteric surfactant must be 0.1% by weight or more.

On the other hand, when a cationic polymer is formulated in an amoutn of more than 10% by weight (comparative Example 14), the viscosity will be too high, and thus production becomes possible.

As a result, it is understood that the amount of cationic polymer formulated is preferably 0.1% by weight to 10% by weight.

Other Exampels are now described, and all of these Examples exhibited an excellent transparency, stability, and washability.

EXAMPLE 13

| | |
|---|---|
| N-lauroyl-L-glutamic acid salts (1.8 equivalent neutralization, sodium/triethanolamine = 35/65) | 55% |
| Lauryl lactate | 2.5% |
| Glycerol | 8% |
| D-sorbitol | 3% |
| Ethyl alcohol | 15% |
| Perfume | q.s. |
| Dye | q.s. |
| Deionized water | balance |

The preparation with the above formulation was carried out in the same manner as described in Example 1.

| | |
|---|---|
| N-mixed fatty acid acyl-L-glutamic acid monosodium salt | 13% |
| N-mixed fatty acid acyl-L-glutamic acid ditriethanolamine salt | 40% |
| Glycerol | 15% |
| Ethyl alcohol | 12% |
| Propyl alcohol | 2% |

-continued

| | |
|---|---|
| Sodium pyrrolidone carboxylate | 0.2% |
| Perfume | q.s. |
| Dye | q.s. |
| Deionized water | balance |

The preparation with the above formulation was carried out in the same manner as described in Example 1.

EXAMPLE 15

| | |
|---|---|
| N-mixed fatty acid acyl-L-glutamic acid monotriethanolamine salt | 40% |
| Caustic soda | 1.6% |
| D-sorbitol | 2% |
| 1,3-Butylene glycol | 10% |
| Coconut fatty acid | 1.5% |
| Ethanol | 15% |
| Perfume | q.s. |
| Dye | q.s. |
| Deionized water | balance |

The preparation with the above formulation was carried out in the same manner as described in Example 1.

EXAMPLE 16

| | |
|---|---|
| N-mixed acid acyl-L-glutamic acid salts (1.6 equivalent neutralization, sodium/triethanolamine = 25/75) | 60% |
| Cationized cellulose (trade name "Polymer JR-400", manufactured by Union Carbide) | 2% |
| Stearylimidazolinium betaine (trade name "Milanol DM" manufactured by Milanol) | 3% |
| Lauroylmethyltaurine sodium salt | 1.2% |
| Myristyl lactate | 1.0% |
| Glycerol | 10% |
| Ethyl alcohol | 15% |
| Perfume | q.s. |
| Dye | q.s. |
| Deionized water | balance |

The preparation with the above formulation was carried out in the same manner as described in

EXAMPLE 1.

| | |
|---|---|
| N-mixed acid acyl-L-glutamic acid | 30% |
| Triethanolamine | 18.2% |
| Caustic soda | 1.6% |
| Hydroxyethylcellulose trimethylammonium chloride (trade name "Polymer JR30M", manufactured by Union Carbide, USA) | 3% |
| Myristylpropylamino acetic acid betaine | 3% |
| Coconut oil fatty acid triethanolamine | 2% |
| Glucose | 2% |
| Pyrrolidone carboxylic acid | 0.5% |
| Ethyl alcohol | 13% |
| Perfume | q.s. |
| Dye | q.s. |
| Deionized water | balance |

The preparation with the above formulation was carried out in the same manner as described in Example 1.

| | |
|---|---|
| N-mixed fatty acid acyl-L-glutamic acid salts (1.7 equivalent neutralization, sodium/triethanolamine = 25/75) | 45% |
| Copolymer type cationic polymeric compound | 20% |

-continued

| | |
|---|---|
| of dimethyldiallyammonium chloride and acrylamide (trade name "Merquat 550", manufactured by Merck) | |
| Laurylsulfobetaine (trade name "Ronzaine 12CS" manufactured by Ronza) | 8% |
| 1,3-Butylene glycol | 10% |
| Camomile extract | 0.1% |
| Ethanol | 12% |
| Perfume | q.s. |
| Dye | q.s. |
| Deionized water | balance |

The preparation with the above formulation was carried out inthe same manner as described in Example 1.

As described above, the transparent solid detergent composition according to the present invention is constituted of N-long chain acyl acidic amino acid salts comprising an alkali metal and ethanolamine at a specific ratio, and therefore, has an excellent transparency, high temperature storability, and good useability.

Also, by an addition of a cationic polymer and an amphoteric surfactant, the dissolution disintegration resistance, frictional solubility, foamability, and low temperature stability can be improved.

We claim:

1. A transparent solid detergent composition comprising 35 to 80 percent by weight of salts of an N-$C_{10-22}$ long chain acyl acidic amino acid composed of the alkali metal salt and the ethanolamine salt, the molar constituent ratio of the alkali metal and ethanolamine being 20:80 to 35:65.

2. A transparent solid detergent composition as claimed in claim 1, wherein the N-$C_{10-22}$ long chain acyl acidic amino acid salts have a neutralization degree of 1.5 to 1.8 equivalents.

3. A transparent solid detergent composition as claimed in claim 1, wherein a cationic polymer and an amphoteric surfactant are further contained.

4. A transparent solid detergent composition as claimed in claim 1, whrein the amount of the salts of the N-$C_{10-22}$ long chain acyl acidic amino acid is 40 to 70 percent by weight.

5. A transparent solid detergent composition as claimed in claim 3, wherein the amount of the cationic polymer and the amphoteric surfactant is 0.1% to 10% by weight based onthe total weight of the composition and the weight ratio of the cationic polymer to the amphoteric surfactant is 95:5 to 5:95.

* * * * *

UNITED STATES PATENT AND TRADEMARK OFFICE

CERTIFICATE OF CORRECTION

PATENT NO. : 5,098,608

DATED : March 24, 1992

INVENTOR(S) : Kiyoshi MIYAZAWA, Kenichi TOMITA, Yoshinobu SAITO, et al.

It is certified that error appears in the above-identified patent and that said Letters Patent is hereby corrected as shown below:

On the Title Page, Assignee [73] of the Patent as follows:

"Shieido" to --Shiseido-- and

"Industry, Ltd." to --Industry Co., Ltd.--

Signed and Sealed this

Nineteenth Day of April, 1994

*Attest:*

*Attesting Officer*

BRUCE LEHMAN

*Commissioner of Patents and Trademarks*